US011473301B2

(12) United States Patent
Miller

(10) Patent No.: US 11,473,301 B2
(45) Date of Patent: Oct. 18, 2022

(54) INSULATED CEMENTITIOUS BUILDING BLOCK SYSTEM

(71) Applicant: Dennis Miller, Las Vegas, NV (US)

(72) Inventor: Dennis Miller, Las Vegas, NV (US)

( * ) Notice: Subject to any disclaimer, the term of this patent is extended or adjusted under 35 U.S.C. 154(b) by 0 days.

(21) Appl. No.: 16/776,388

(22) Filed: Jan. 29, 2020

(65) Prior Publication Data

US 2021/0230872 A1 Jul. 29, 2021

(51) Int. Cl.

| | |
|---|---|
| ***E04C 1/41*** | (2006.01) |
| ***E04B 2/54*** | (2006.01) |
| *E04B 2/02* | (2006.01) |

(52) U.S. Cl.

CPC ..... *E04C 1/41* (2013.01); *E04B 2/54* (2013.01); *E04B 2002/0206* (2013.01); *E04B 2002/0293* (2013.01)

(58) Field of Classification Search

None

See application file for complete search history.

(56) References Cited

U.S. PATENT DOCUMENTS 3,204,381 A * 9/1965 Perreton ..... E04B 2/46 52/309.12
4,071,989 A * 2/1978 Warren ..... E04C 1/41 181/285
4,073,111 A * 2/1978 Warren ..... E04C 1/41 52/407.1
4,380,887 A * 4/1983 Lee ..... B28B 7/162 52/405.1
4,748,782 A * 6/1988 Johnson ..... E04B 2/06 52/220.2
4,856,249 A * 8/1989 Nickerson ..... E04C 1/41 52/405.4
5,355,647 A * 10/1994 Johnson ..... E04C 1/41 52/223.5
5,528,874 A 6/1996 Schmid
6,205,726 B1 3/2001 Hoadley
6,513,293 B2 2/2003 Miller
(Continued)

OTHER PUBLICATIONS

International Search Report and Written Opinion dated Apr. 23, 2021 for PCT Application No. PCT/US21/15890, 9 pages.

*Primary Examiner* — Joshua K Ihezie

(74) *Attorney, Agent, or Firm* — FisherBroyles, LLP; Rob L. Phillips

(57) ABSTRACT

A concrete building block for masonry block walls is formed with first, second and third spaced parallel rectangular face shells, where the second face shell is intermediate the first and third face shells. First and second vertical end cross webs connect the first and second face shells and first and second spaced intermediate vertical cross webs connect the second and third face shells. Insulating inserts include end protrusions extending outwardly at the top edge thereof to fit into notches of the cross webs and include cutouts to accommodate mortar crumbs. The inserts further include longitudinal notches along the entire bottom edges and longitudinal notches along the entire top edges wherein said longitudinal notches along a bottom edge are dimensioned to mate with longitudinal notches along a top edge of neighboring ones of the insulating inserts creating an overlap that serves to (i) insulate against temperature transfer and (ii) provide a sound barrier.

10 Claims, 17 Drawing Sheets

(56) References Cited

U.S. PATENT DOCUMENTS

| | | | | |
|---|---|---|---|---|
| 8,091,308 | B2 * | 1/2012 | Westmoreland | E04B 2/8629 52/405.4 |
| 10,612,234 | B2 * | 4/2020 | Wright | E04B 2/26 |
| 2001/0022057 | A1 * | 9/2001 | Miller | E04C 1/397 52/405.1 |
| 2008/0060300 | A1 * | 3/2008 | Westmoreland | E04C 1/41 52/405.4 |
| 2008/0184650 | A1 * | 8/2008 | Fischer | E04B 2/8629 52/606 |
| 2008/0236081 | A1 | 10/2008 | Kennedy | |
| 2019/0177972 | A1 * | 6/2019 | Wright | E04B 2/22 |

* cited by examiner

INSULATED CEMENTITIOUS BUILDING BLOCK SYSTEM

FIELD OF THE INVENTION

The embodiments of the present invention relate to an improved insulated cementitious building block system.

BACKGROUND

Building blocks made of concrete or cementitious material are widely used for building structures. Typically, these blocks are laid in running courses with horizontal and vertical mortar joints, known as butt joints and head joints, to construct a wall. The mortar bonds the block material together to form the completed wall construction. Conventional cement block wall construction employs blocks which are closed at the ends by cross webs, and which typically include a single cross web substantially at the midpoint of the block. The open spaces between the cross webs are used to provide air spaces for insulation purposes and to reduce the weight of the block. These open spaces also are used to accommodate reinforcing bar placement and grout cells for providing a structurally reinforced wall.

Efforts have been made to improve the insulation qualities of concrete block walls by filling the voids between the supporting cross webs with molded insulating material during manufacture of the block. When such cells are prefilled, however, and the block is stored in an outdoor storage yard pending shipment, the insulating material frequently deteriorates in reaction to ultraviolet rays and the like. In addition, when the hollow cells in a masonry block are pre-filled at manufacture, the block is difficult to handle, because of an inadequate means of picking up the block. The foam fills the cores preventing a mason from efficiently grasping the central web or the end web of the block and placing it, a process that is repeated for each and every block during construction. Masons generally prefer a block which can be handled with one hand so that the other hand can be free to hold a trowel, some other tool, or carry another block.

It is desirable to provide an improved insulated masonry building block which overcomes the disadvantages of the prior art, and which employs generally conventional masonry techniques in wall construction using the block coupled with effective insulation and ease of handling.

SUMMARY

The embodiments of the present invention broadly comprise an insulated masonry building block system including masonry blocks constructed with first, second and third spaced parallel rectangular face shells, commonly referred to as face shells within the industry, in which the second face shell is intermediate the first and third face shells. First and second vertical end cross webs connect the first and second face shells and each of the first and second end cross webs have a notch in them extending a predetermined distance from the top toward the bottom. First and second spaced intermediate vertical cross webs then are located on planes between the planes of the first and second end webs to connect the second and third face shells, leaving open cavities at the ends of the second and third face shells. Each of these intermediate cross webs also have a notch therein extending from the top a predetermined distance toward the bottom.

The insulated masonry building block system further includes a first insulating insert dimensioned to substantially fill the space between the first and second face shells and the first and second end cross webs with end protrusions extending outwardly near the top thereof to fit into the notches in the first and second end cross webs. The first insulating insert includes top and bottom edges, with end protrusions extending outwardly at the top edge thereof to fit into notches of cross webs of said masonry building blocks, said end protrusions having cutouts in bottoms thereof to accommodate mortar crumbs; and a longitudinal notch along the entire bottom edge and a longitudinal notch along the entire top edge wherein said longitudinal notch along said bottom edge is dimensioned to fit into a longitudinal notch along a top edge of a neighboring one of said insulating inserts creating an overlap that serves to (i) insulate against temperature transfer and (ii) provide a sound barrier.

The insulated masonry building block system may further include a second insulating insert dimensioned substantially to fill the space between the first and second spaced intermediate cross webs with end protrusions extending outwardly at the top edge thereof to fit into the notches in said first and second spaced intermediate cross webs, said end protrusions having cutouts in bottoms thereof to accommodate mortar crumbs; and a longitudinal notch along the entire bottom edge and a longitudinal notch along the entire top edge wherein said longitudinal notch along said bottom edge is dimensioned to fit into a longitudinal notch along a top edge of a neighboring one of said second insulating inserts creating an overlap that serves to (i) insulate against temperature transfer and (ii) provide a sound barrier.

Other variations, embodiments and features of the present invention will become evident from the following detailed description, drawings and claims.

DETAILED DESCRIPTION

Figure 1:
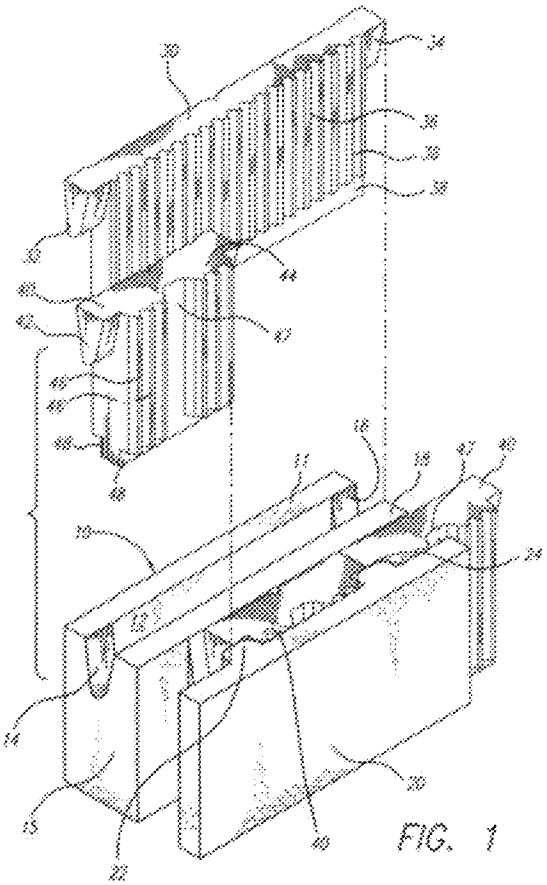
FIG. 1 illustrates a partially exploded perspective view of a first embodiment of the present invention.

For the purposes of promoting an understanding of the principles in accordance with the embodiments of the present invention, reference will now be made to the embodiments illustrated in the drawings and specific language will be used to describe the same. It will nevertheless be understood that no limitation of the scope of the invention is thereby intended. Any alterations and further modifications of the inventive feature illustrated herein, and any additional applications of the principles of the invention as illustrated herein, which would normally occur to one skilled in the relevant art and having possession of this disclosure, are to be considered within the scope of the invention claimed.

Reference now should be made to the drawings, in which the same reference numbers are used throughout the different figures to designate the same components. FIG. 1 is an exploded front perspective view of a preferred embodiment of the invention. As shown in FIG. 1, a concrete or cementitious building block 10 is constructed of three primary parallel face shells, 11, 18 and 20. The face shells are of equal length and have a top surface located in a first horizontal plane and a bottom surface located in a second horizontal plane. The block 10 has external dimensions which are selected to be comparable to the standard dimensions of concrete building blocks throughout the construction industry.

Figures 3, 4, 5, 6:
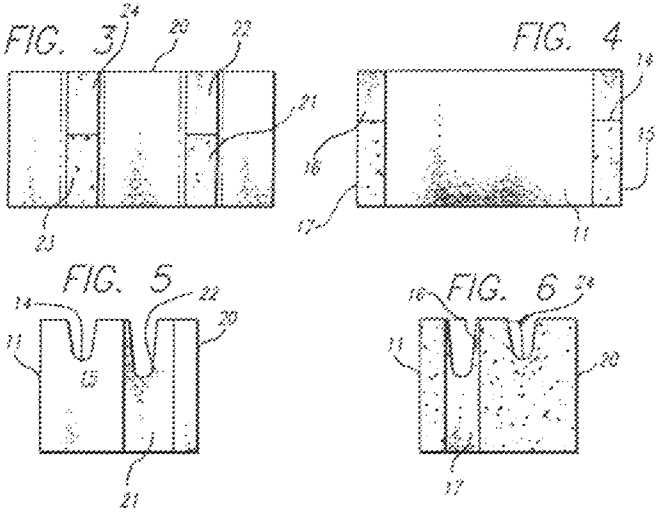
FIG. 3 illustrates a cross-sectional view taken along the line 3-3 of FIG. 2 according to the embodiments of the present invention.
FIG. 4 illustrates a cross-sectional view taken along the line 4-4 of FIG. 2 according to the embodiments of the present invention.
FIG. 5 illustrates an end view taken along the line 5-5 of FIG. 2 according to the embodiments of the present invention.
FIG. 6 illustrates a cross-sectional view taken along the line 6-6 of FIG. 2 according to the embodiments of the present invention.
Figure 7:
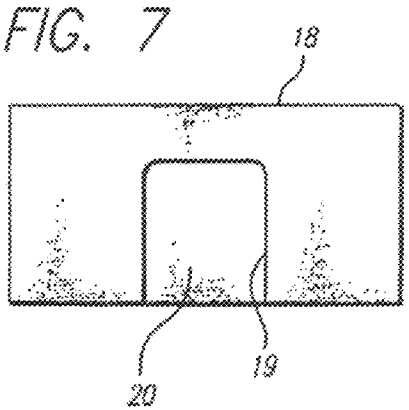
FIG. 7 illustrates a cross-sectional view taken along the line 7-7 of FIG. 2 according to the embodiments of the present invention.

The opposite ends of the face shells 11 and 18 are joined together to form a closed compartment by first and second vertical end cross webs 15 and 17. These cross webs 15 and 17 have U-shaped notches 14 and 16 located in them extending a short distance from the top of the cross webs toward the bottoms thereof. This is shown most clearly in FIGS. 1, 5 and 6.

Figure 2:
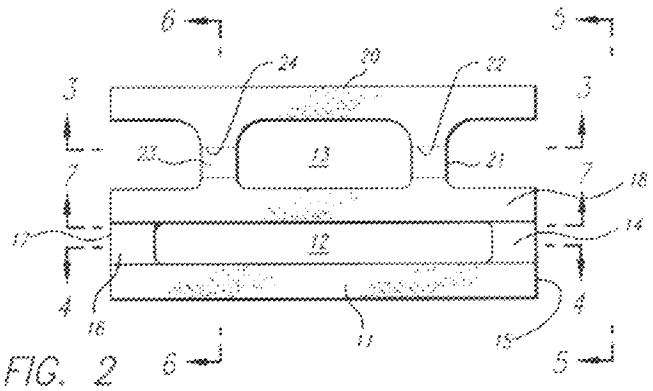
FIG. 2 illustrates a top view of a portion of the first embodiment shown in FIG. 1 according to the embodiments of the present invention.

As shown most clearly in FIG. 2, intermediate cross webs 21 and 23, located in parallel planes spaced between the planes of the cross webs 15 and 17, are used to join the face shells 18 and 20 together. These intermediate cross webs also have notches 22 and 24, respectively, located in them, again as shown most clearly in FIGS. 2, 5 and 6.

The resulting structure of the block is illustrated in its various parts in FIGS. 2 through 7. From an examination of FIG. 2, it is apparent that a cavity 12 is located between the face shells 11 and 18 and the end cross webs 15 and 17. Another cavity 13 is formed between the face shells 18 and 20 and the cross webs 21 and 23. All of the face shells 11, 18 and 20 and the cross webs 15, 17, 21 and 23 have a uniform thickness or cross section from the top of the block to the bottom to provide the maximum volume for the cavities which are formed between them.

The center face shell 18 is designed with an ergonomically designed handle formed by a void or U-shaped hollow area located approximately 2½ inches from the top of the face shell 18. This is shown most clearly in FIG. 7. The area over the top of this void 19 a comfortable, easy to grip handle for manipulating the block 10 during the construction of a wall. This void of material also serves to lighten the total weight of an individual block without compromising its structural integrity. The bottom of this handle area, which is parallel to the top of the face shell 18, also may be molded with curved or rounded edges to dramatically decrease wear and abrasion on the fingers or gloves of a workman installing these blocks in a wall.

In constructing a wall with the blocks shown in FIGS. 1 through 7, standard mortar masonry practices are used to align and plumb the walls. The blocks are set in place in courses, utilizing the same techniques which are employed for standard cement building blocks in the industry. After a course of blocks has been laid, the foam inserts 30 and 40 which are shown in the exploded view of FIG. 1 are fit into the appropriate cell cavities. The elongated enclosed cell cavities 12 in each of the individual blocks are filled with an insulated foam insert 30, as shown in FIG. 1. This foam insert is designed to be snug fitting in the cavity 12, but to further facilitate its insertion, ribs 36 are formed on one of the surfaces so that if there is an anomaly in the interior surfaces of the face shells 11 or 18, these ribs easily are shaved down by the naturally abrasive cementitious material while being inserted to provide a quick and simple fit of the insulating insert in the cavity 12. To hold the insert 30 in place, there are outwardly projecting protrusions or ears 32 and 34, on opposite sides, located near its upper surface. These projections 32 and 34 fit into the U-shaped notches 14 and 16 in the vertical end cross webs 15 and 17 to hold the insulating insert 30 in place. The insert 30 has a top to bottom dimension selected to cause it to be located within the cavity 12 in such a manner that it does not extend above the upper edge or upper surface of the face shells 11, 18 and 20.

It readily can be seen that when a series of the blocks 10 are laid in a course in a conventional manner, the head joints on the sides are mortar filled, as are the bottom butt joints. It is well known that standard mortar masonry practices frequently result in some excess mortar seepage along the bottom of the cavity 12 and along the edges spilling into the open-ended cavities located on the right and left-hand sides of the intermediate cross webs 21 and 23, shown in FIG. 2. To prevent a break in the mechanical bond which is provided by this mortar and to avoid disturbing the mortar, the insulating insert 30 is undercut along its edges at 38, as shown in FIG. 1. Thus, the bottom of the insulating insert 30 is stepped back from the face shells 11 and 18 so that no interference with the mortar seepage on the butt joints occurs. The bottom of the insert 30, between the undercut portions, extends below the face shells 18 and 20 into the space created by the mortar in the butt joints. A second set of shorter inserts 40 then is provided to fit into the cavity 13 between the face shells 18 and 20 and the intermediate cross webs 21 and 23, again as illustrated in FIG. 1. The inserts 40 also have vertical ribs 46 on them to accommodate any anomalies which may be present in the cavity 13 to permit easy insertion of the insulating inserts 40 into the cavity, as shown in FIG. 1. In addition, the center of each of the insulating inserts 40 has a vertical notch or groove 47 extending from the top to the bottom to space the insert 40 from the interior of the face shell 20. As with the insulating inserts 30, the insulating inserts 40 also have projecting ears or tabs 42 and 44, on opposite sides, for resting in the notches 22 and 24, respectively, of the block 10. As with the insulating inserts 30, the insulating inserts 40 are placed in the blocks in the manner shown in FIG. 1 after a course of blocks has been laid.

As is apparent from an examination of FIG. 1, the inserts 40 not only are placed in the region 13 between the webs 21 and 22 of an individual block, but also bridge the space between these cross webs and the mating cross webs of the adjacent block in the manner shown in FIG. 1. When this is done, the center vertical groove 47 is located in the region of the head joints between the blocks to accommodate any mortar seepage which takes place in this area. This avoids disturbing the mortar at the head joints. As with the inserts 30, the inserts 40 also include an undercut or notch 48 at the bottom to accommodate mortar seepage along the butt joints at the bottoms of the blocks and the inserts 40 extend slightly below the bottom plane of the blocks. As a consequence, no break in the mechanical bond is occasioned by insertion of the insulating inserts 30 and 40 in the manner shown in FIG. 1 after a course of blocks has been laid. This unique and precise design of the foam inserts does not interfere with the mortar (wet or dry) excess areas when the inserts are placed into appropriate cell cavities in the blocks.

Figure 10:
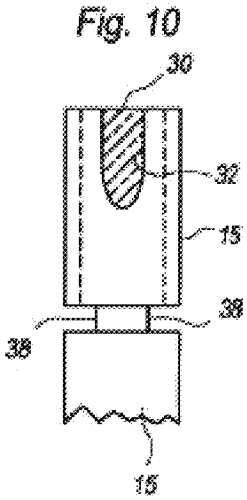
FIG. 10 illustrates an end view of a portion of one embodiment of the present invention constructed into a wall according to the embodiments of the present invention.

FIG. 10 is a partially cut-away end view of the portion 15 of the block shown in FIGS. 1 and 2 illustrating the orientation of a pair of blocks 15 in vertically adjacent courses, and showing the orientation of the insulating insert 30 when the blocks 15 are mortar set, one upon the other. The mortar has not been shown in FIG. 10 in order to clarify the drawing. As is illustrated in FIG. 10, the protrusion 32 fits into the U-shaped notch 14 to allow the upper surface of the insert 30 to be co-planar with the top of the block. The bottom or lower edge of the insert 30 rests on the top of the corresponding insert 30 in the next lower course of blocks 15. The longitudinal undercut notches 38 on each side of the insert 30 provide a space for mortar seepage, as is readily apparent from an examination of FIG. 10.

Figure 11:
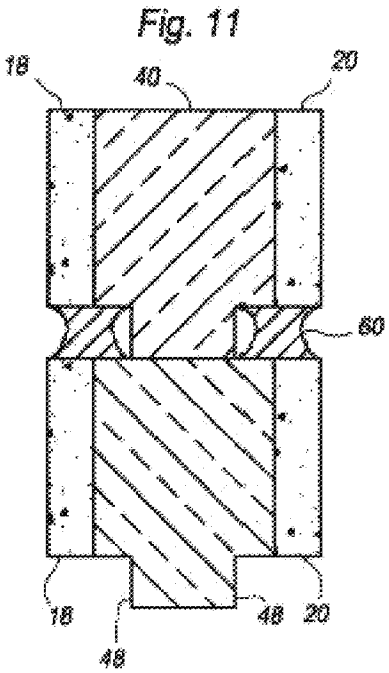
FIG. 11 illustrates a cross-sectional view of a portion of one embodiment of the present invention showing specific features thereof according to the embodiments of the present invention.

FIG. 11 is a cross-sectional view of a portion of the spaced-apart walls 18 and 20 of the block shown in FIGS. 1 and 2 illustrating the orientation and location of insulating inserts 40 when these inserts are in place in blocks of immediately adjacent upper and lower courses of blocks installed into a wall by means of a conventional mortar construction. An identical orientation and location of the insulating inserts 30 also exists as shown in FIG. 10. As shown in FIG. 11, the notches 48 extend from the lower plane of the walls 18 and 20 of the upper block to the lower edge or bottom surface of the insert 40 by a distance equal to the finished thickness and seepage of a mortar joint 60, as illustrated. The top edge or upper surface of the insert 40 is located in the same plane as the top edges of the walls 18 and 20 of the block. The notches 48 extend longitudinally along the entire bottom edge of both sides of the inserts 40, as illustrated in FIG. 11.

Since the wall thicknesses of the face shells 11, 18 and 20 and the wall thickness of the cross webs 15, 17, 21 and 23 are uniform from top to bottom (or have a slight taper from top to bottom for manufacturing purposes), a maximum volume of the cavities in the block is provided. This permits the thicknesses of the insulating inserts 30 and 40 to be uniform (or nearly uniform) from top to bottom to permit a maximum filling of insulating material into the blocks during the construction of a wall.

As desired, various ones of the cells in the blocks may be filled with rebar and grout installation, in accordance with standard concrete block installation practices. It also is a simple matter to provide horizontal rebar in various courses of a wall by laying the rebar in the notches 14, 16 or 22, 24 and applying grout as necessary. Obviously, when this is done, those particular blocks are not provided with the insulating inserts 30 and 40.

An additional improvement may be provided in the middle face shell 18 in the form of precision vertical scoring at each end of the handle formed by the undercut or void area 19. This permits a mason to lightly tap the handle with a hammer to easily remove the handle in the event that a vertical rebar protruding from either footings, stem walls or lower bond beams interferes with the handle.

Figure 9:
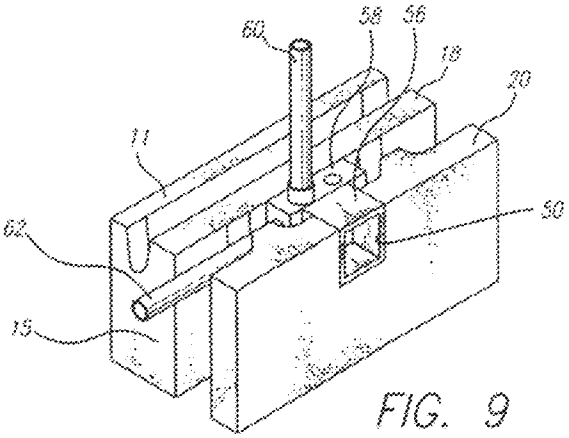
FIG. 9 illustrates front perspective view illustrating additional features of the first embodiment shown in FIGS. 1 and 2 according to the embodiments of the present invention.

As illustrated in FIG. 9, a significant advantage of the three face shell construction of the block is in the manner in which electrical box placements can be effected within the masonry wall. Standard or conventional cement masonry blocks have two deep (approximately 5") cell cavities, one on each side of a middle cross web. Typically, a mason cuts the block face where an electrical box is specified in the wall. Standard, readily available electrical box configurations are considerably less deep than the depth of these standard cavities. A, mason has no efficient method of securing an electrical box flush with the inside face of the block. There is no apparatus currently available, short of time consuming and costly masonry screws, to secure electrical boxes in place during construction when standard masonry blocks are used.

In the block which is shown in FIGS. 1 through 7 and 9, however, electrical box placement is greatly facilitated. The placement procedure identically begins with the mason cutting the block face to form a rectangular cutout 50, as shown in FIG. 9. A standard, readily available, universally manufactured electrical box 58/56 then is placed in the cutout, simply by sliding it into the cavity from the top to rest in place in the cutout box opening. The rear of the box 50 rests against the handle area of the center face shell 18 to precisely hold it in place. Again, the open cells allow for standard, readily available, universally manufactured and approved electrical conduit chases, both vertical 60 and horizontal 62 to be used without the requirement of actually installing any wiring. The conduits can be placed in the blocks in the manner shown and extend through various courses and from block-to-block within a course in the same manner as discussed previously for the installation of rebar. As a consequence, the block construction greatly facilitates subsequent electrical wiring of a building using the structures which have been shown.

Figure 8A:
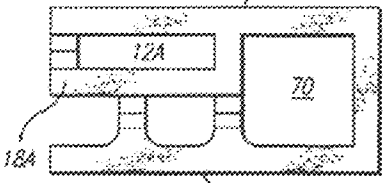
FIGS. 8A and 8B illustrate alternative constructions of the first embodiment shown in FIGS. 1 and 2 according to the embodiments of the present invention.
Figure 8B:
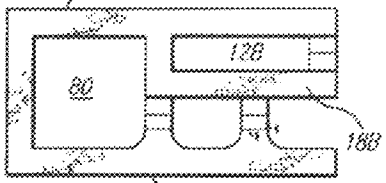

FIGS. 8A and 8B show variations of the top view of the block shown in FIGS. 1 and 2 which may be used as corner or in-line pilaster blocks, which alternatively can be stacked in a running bond to provide a larger grout cell, as may be required by structural engineering. These cells 70 and 80 duplicate regular concrete block cell dimensions, and, therefore, structural capability, as well as serving as a corner block to provide a finished corner, since the block shown in FIGS. 1 through 7 has open cavities on its ends and is not satisfactory for corner construction.

Figure 12A:
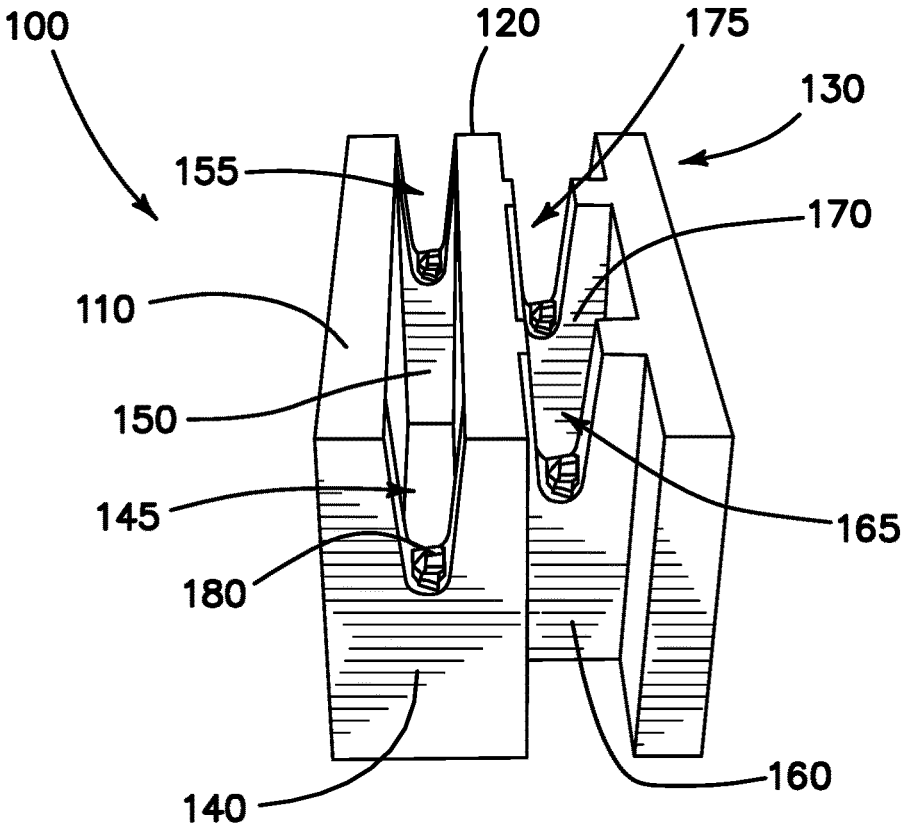
FIGS. 12A and 12B illustrate a perspective end view and top down view of a block of the type used with the embodiments of the present invention.
Figure 12B:
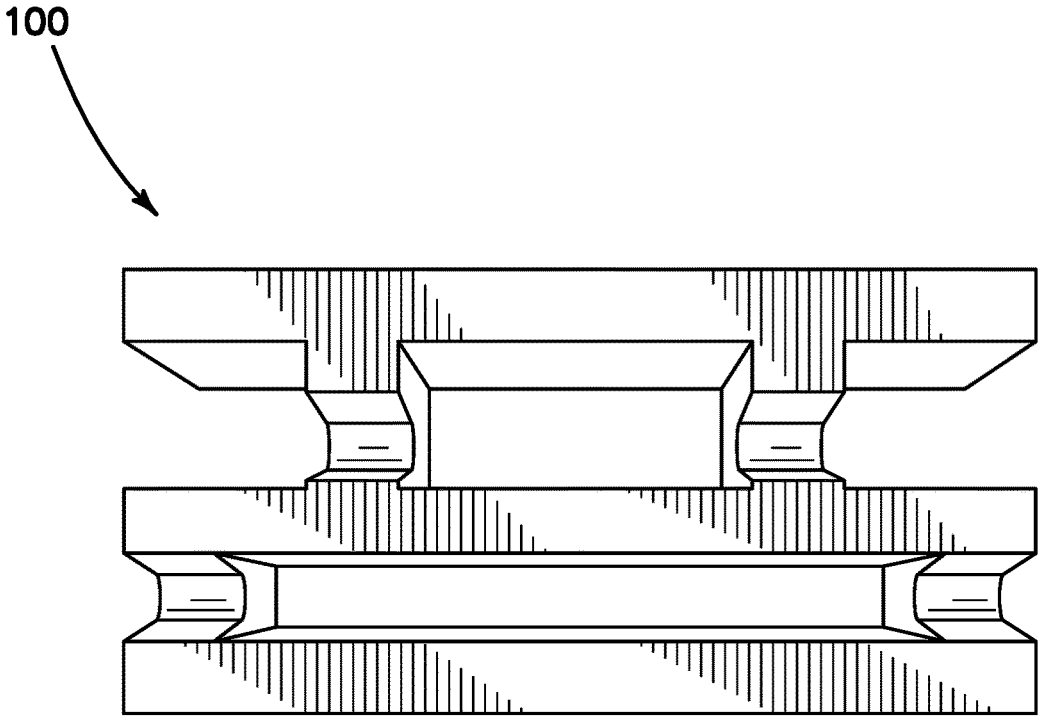

FIG. 12 illustrates an upper perspective view of a block 100 used with a second embodiment of the present invention. The block 100, like the block 10 in FIG. 1, includes a first face shell 110, second face shell 120, third face shell 130, first vertical end cross web 140, second vertical end cross web 150, first intermediate vertical cross web 160 and second intermediate vertical cross web 170. The first and second vertical end cross webs 140, 150 connect the first and second face shells 110, 120 and each of the first and second end cross webs 140, 150 have a notch 145, 155 therein extending a predetermined sloping distance from the top toward the bottom. The first and second spaced intermediate vertical cross webs 160, 170 are located on planes between the planes of the first and second end cross webs 140, 150 connecting the second and third face shells 120, 130. Each of these intermediate vertical cross webs 160, 170 also has a notch 165, 175 therein extending from the top a predetermined sloping distance toward the bottom.

During the normal building block manufacturing process, some excess of the aggregate cement mixture from which the building blocks 100 are fabricated inadvertently falls into the notches 145, 155, 165 and 175 of the building blocks 100. This unwanted aggregate debris, termed "crumbs" 180 herein becomes a nuisance to the mason during the installation of the insulating inserts 30, 40 (shown in FIG. 1) because the pre-formed ears 32, 34 are routinely inhibited from full insertion into the cores by the "crumbs" 180.

Figure 13A:
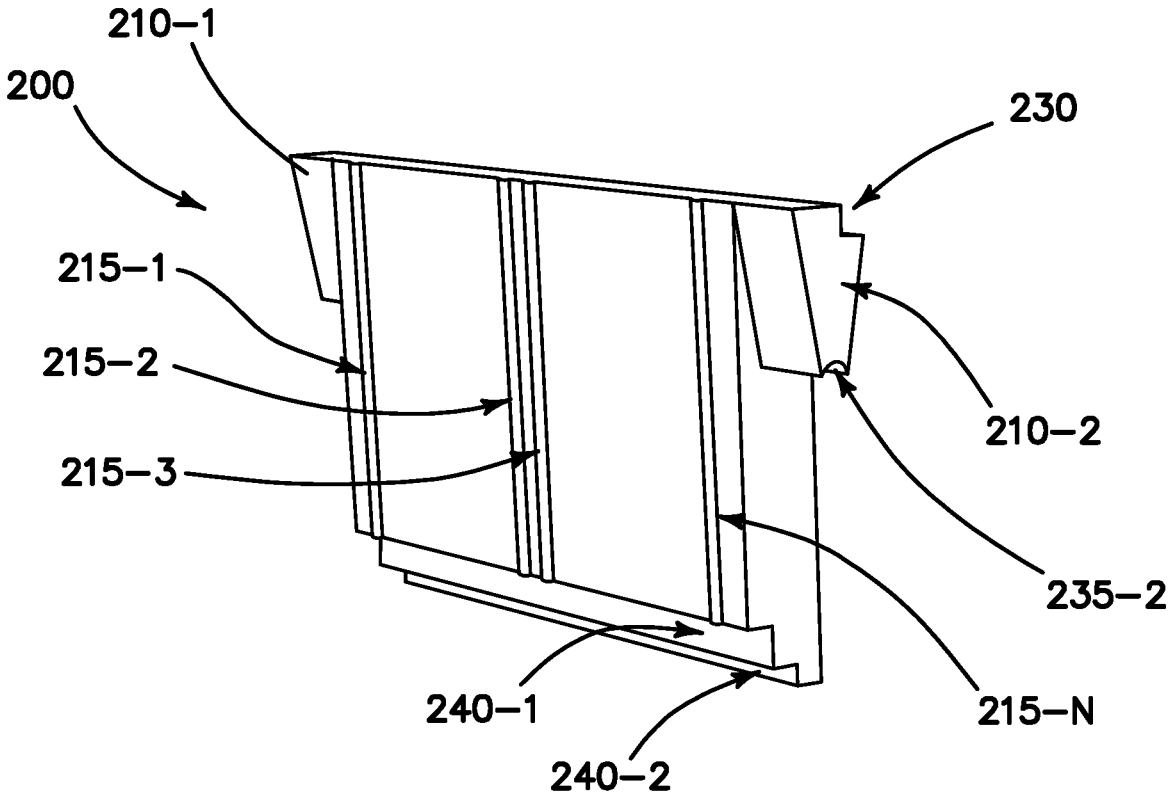
FIGS. 13A and 13B illustrate second embodiment first inserts according to the embodiments of the present invention.
Figure 13B:
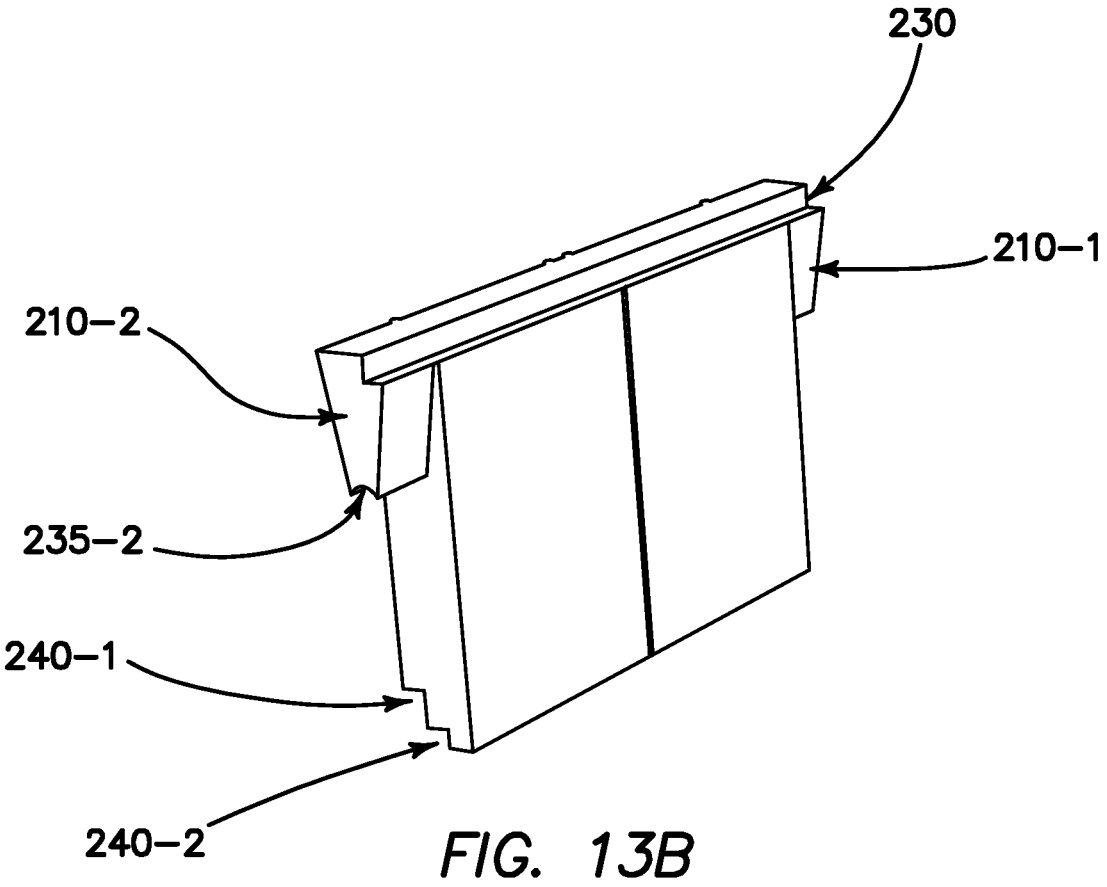
Figure 17A:
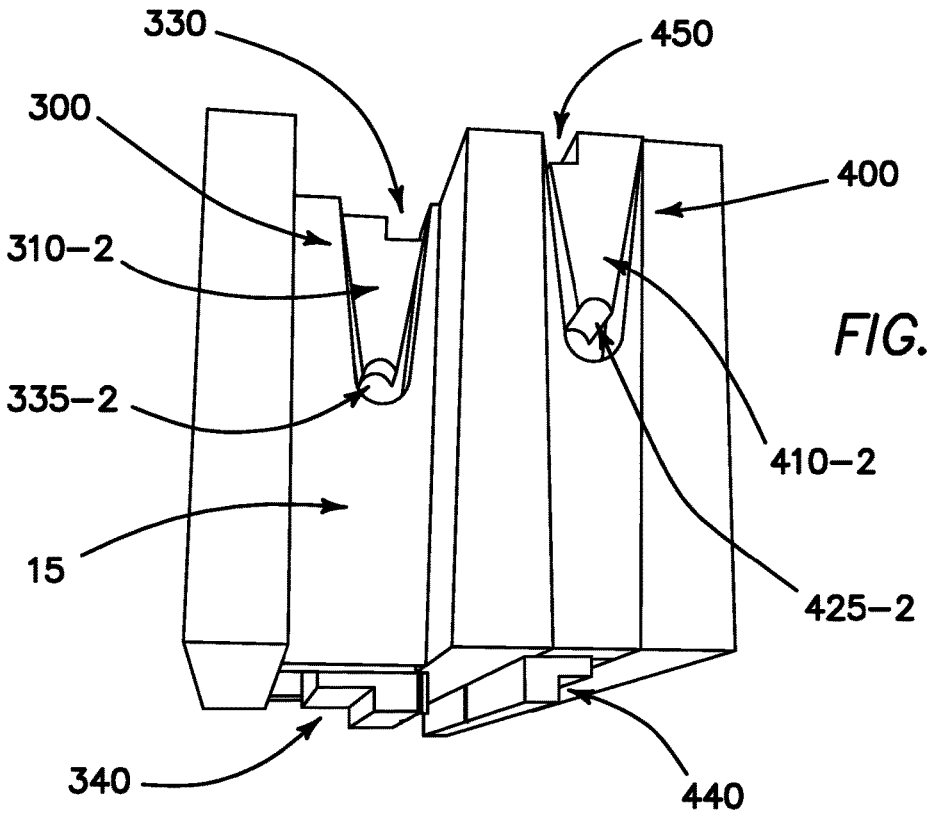
FIGS. 17A and 17B illustrate a third embodiment first insert and second embodiment insert positioned within a building block according to the embodiments of the present invention.

Now referring to FIGS. 13A and 13B, first embodiment insulating insert 200 is dimensioned to substantially fill the space between the first and second face shells 110, 120 and the first and second end cross webs 130, 140. This insulating insert 200 is also deemed a short insert. The insert 200 has end protrusions 210-1, 210-2 extending outwardly from both sides near the top thereof to fit into the notches 145, 155 in the first and second end cross webs 140, 150. The end protrusions 210-1, 210-2 include cut-outs 235-1, 235-2 proximate the bottom thereof to accommodate the crumbs and prevent unwanted interference with the installation of the first insulating insert 200. Vertically running ribs 215-1 through 215-N accommodate any anomalies which may be present in the cavity of a building block to permit easy insertion of the inserts 200 into the cavity. FIG. 17A shows an insulating insert 200, having the cut-out 235, in position for installation into the block 100.

Figure 15A:
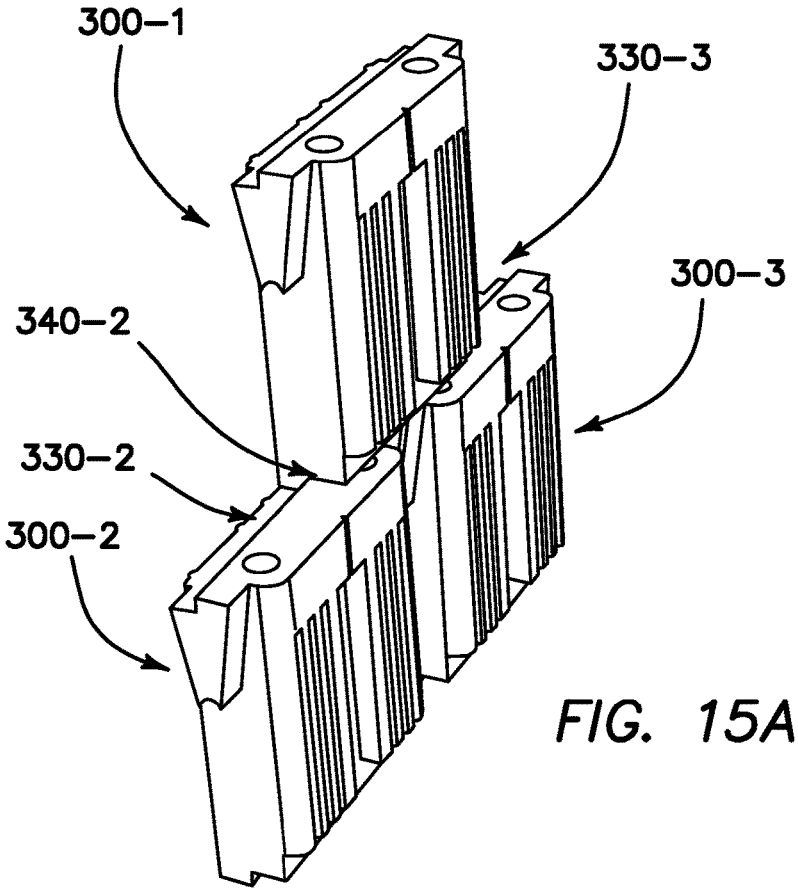
FIGS. 15A and 15B illustrate the third embodiment first inserts stacked according to the embodiments of the present invention.
Figure 15B:
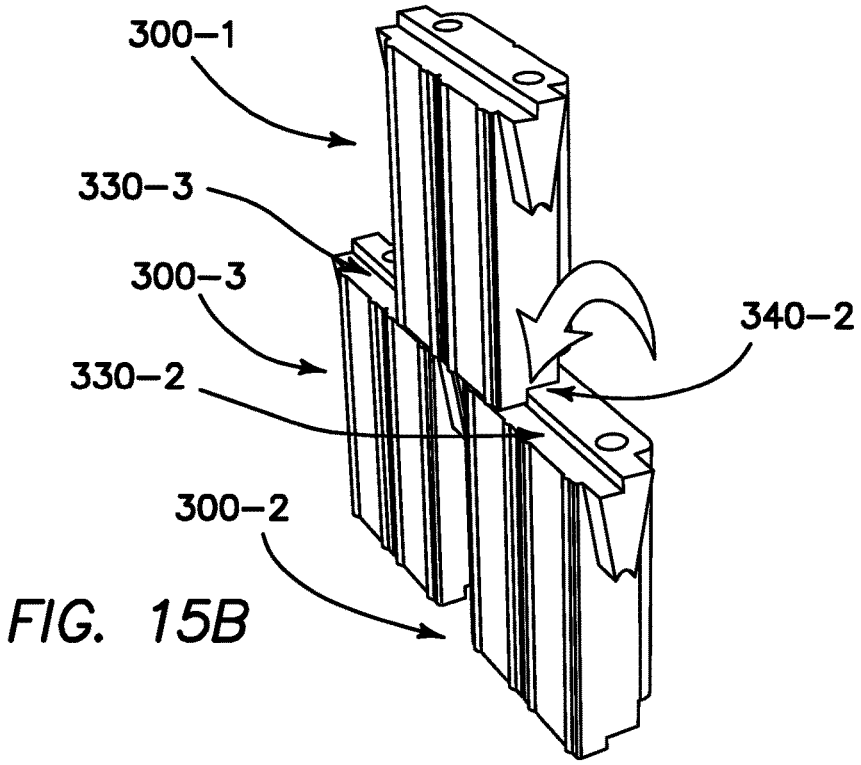

The first insulating insert 200 also has a pair of longitudinal notches 240-1, 240-2 along the bottom thereof and a longitudinal notch 230 along the top thereof. Longitudinal notch 240-2 is dimensioned to mate with the top longitudinal notch 230 of a neighboring insulating insert as shown in FIGS. 15A and 15B.

Figure 14A:
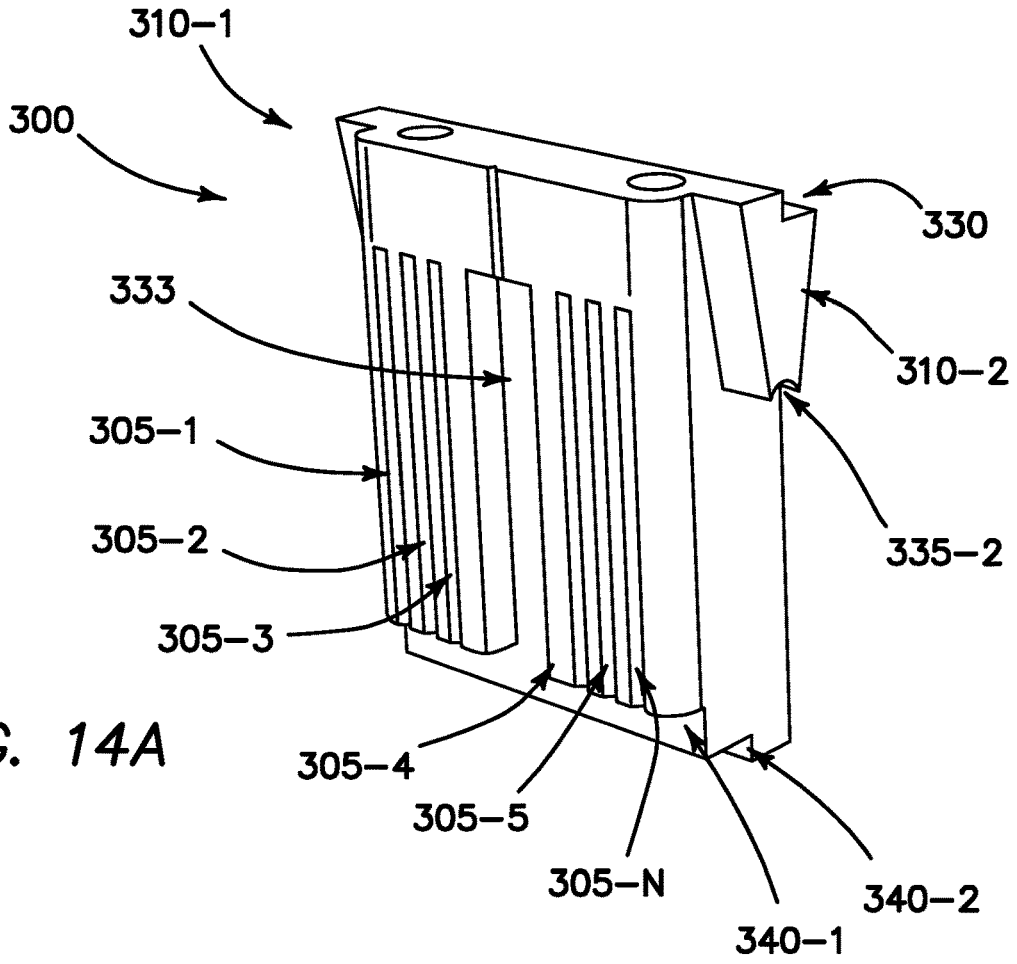
FIGS. 14A and 14B illustrate third embodiment first inserts according to the embodiments of the present invention.
Figure 14B:
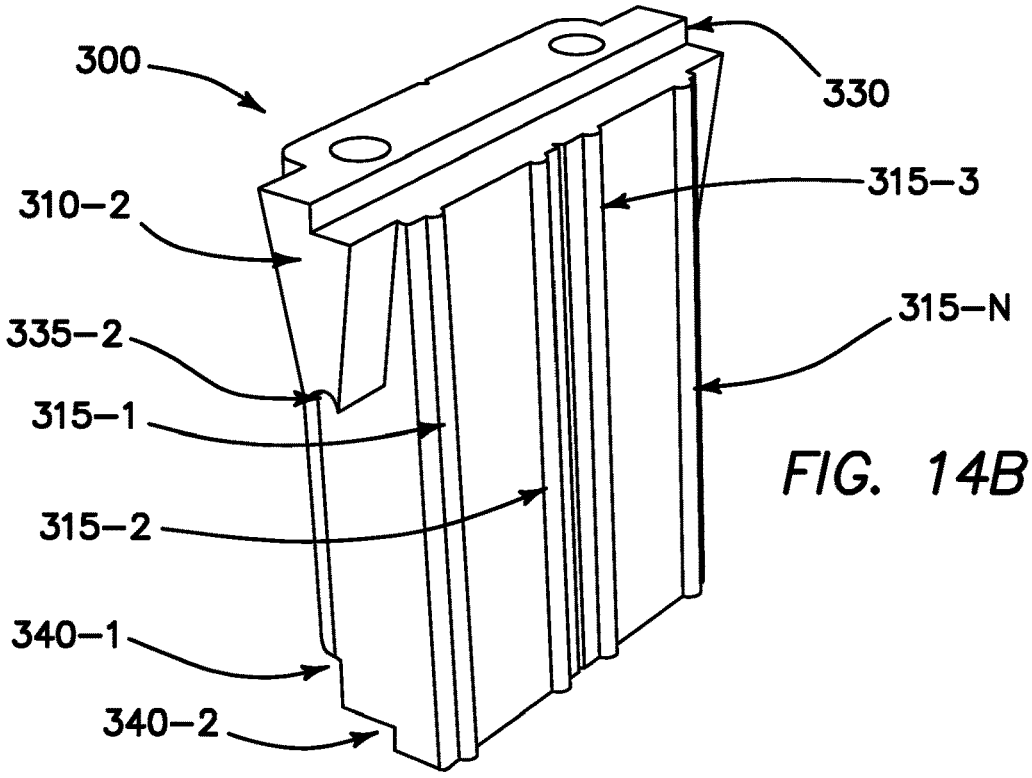

FIGS. 14A and 14B show second embodiment insulating insert 300 similar to said first embodiment insulating insert 200 having end protrusions 310-1, 310-2, cut-outs 335-1, 335-2, a pair of longitudinal notches 340-1, 340-2 along the bottom thereof and a longitudinal notch 330 along the top thereof. The second embodiment insulating insert 300 also includes a series of vertically running channels 305-1 through 305-N on a first side and vertically running ribs 315-1 through 315-N on a second side. The vertically running ribs 315-1 through 315-N accommodate any anomalies which may be present in the cavity of a building block to permit easy insertion of the inserts 300 into the cavity. As shown best in FIG. 18A, the vertically running channels 305-1 through 305-N serve to break up sound waves as described in more detail below.

Now referring to FIGS. 15A and 15B, longitudinal notch 340-2 in insert 300-1 extends below a mortar joint and into the longitudinal notches 330-2, 330-3 of inserts 300-2, 300-3 respectively. In this manner, the inserts 300 are configured to stack such that no gap exists between the bottom of an upper insert and the top of a lower insert. Indeed, the mating overlap created by the lower longitudinal notches and the upper longitudinal notches serves to insulate against temperature transfer and provide a more efficient sound barrier.

Inserts 200, 300 may include a vertical groove 333 extending from the top to the bottom thereof at substantially the midpoint. The vertical groove 333 is located in the region of the head joints between the blocks to accommodate any mortar seepage which takes place in the area.

Figure 16A:
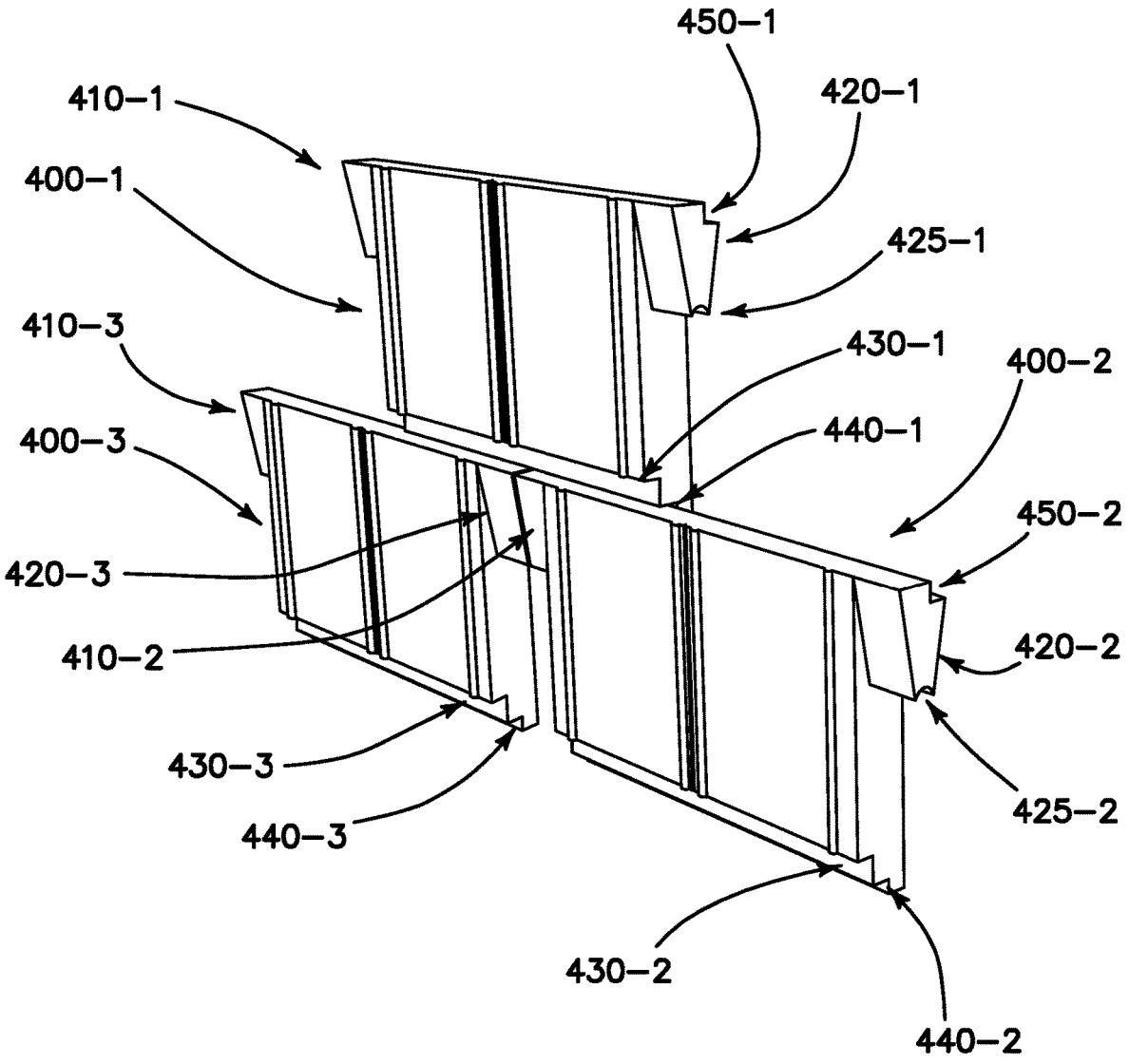
FIGS. 16A and 16B illustrate second embodiment second inserts stacked according to the embodiments of the present invention.
Figure 16B:
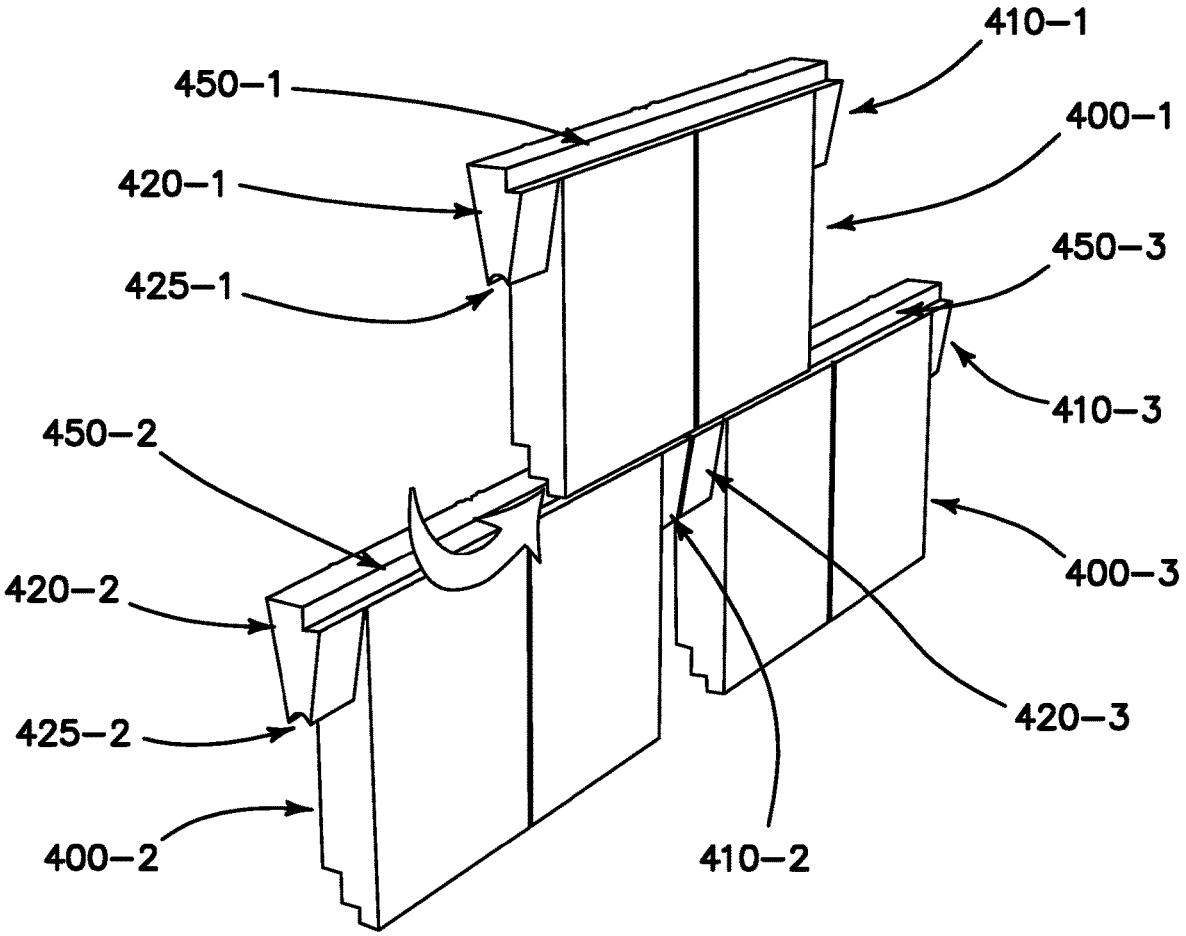

Now referring to FIGS. 16A and 16B, second insulating inserts 400-1 through 400-3 are shown in a stacked arrangement. Inserts 400-1 through 400-3 are dimensioned substantially to fill the space between the first and second spaced intermediate vertical cross webs 160, 170. The second insulating inserts 400-1 through 400-3 have end protrusions 410-1 through 410-3 and 420-1 through 420-3 extending outwardly from the top thereof on each side to fit into the notches 165, 175 in the intermediate vertical cross webs 160, 170. These insulating inserts 400-1 through 400-3 are also deemed long inserts. The second insulating inserts 400-1 through 400-3 have a length sufficient to allow a single insert to individually fill the space between vertical cross webs 160, 170. The end protrusions 410-1 through 410-3 and 420-1 through 420-3 include mortar-accommodating cut-outs 415-1 through 415-3 and 425-1 through 425-3, respectively.

The insulating inserts 400-1 through 400-3 have first longitudinal notches 430-1 through 430-3 and second longitudinal notches 440-1 through 440-3 along the bottom thereof and longitudinal notches 450-1 through 450-3 along the top thereof. Longitudinal notches 325-1, 325-2 are dimensioned to mate with the longitudinal notches 330-1, 330-2 of neighboring insulating inserts 300-1, 300-2 as shown in FIGS. 14A and 14B.

FIGS. 16A and 16B show insert 400-1 above inserts 400-2, 400-3 such that longitudinal notch 440-1 extends below a mortar joint and into notches 450-2, 450-3 in the top of insert 400-2, 400-3, respectively. In this manner, the inserts 400 are configured to stack such that no gap exists between the bottom of the top insert 400-1 and the top of the bottom inserts 400-2, 400-3. Indeed, the mating overlap created by the lower longitudinal notches and the upper longitudinal notches serves to insulate against temperature transfer and provide a more efficient sound barrier.

Figure 17B:
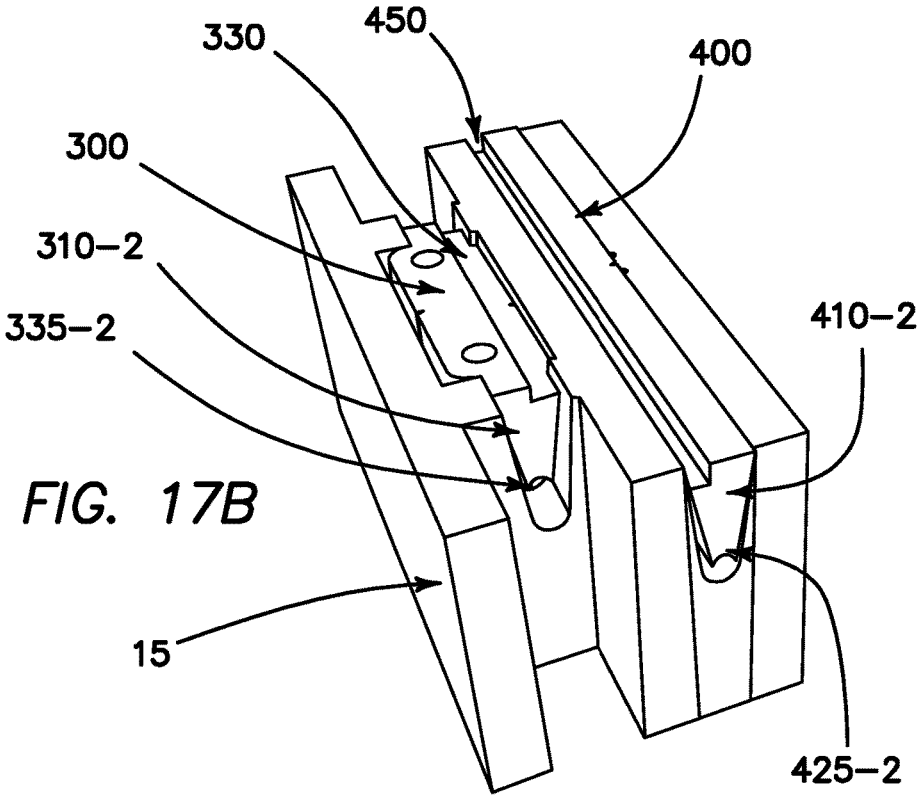

FIGS. 17A and 17B illustrate a third embodiment first insert 300 and second embodiment insert 400 positioned within a building block 15 according to the embodiments of the present invention. As best shown in FIG. 17A, the cut-outs 335-2, 425-2 accommodate crumbs 180 of the type shown in FIG. 12A. FIG. 17A also shows notches 340, 440 extending below a bottom of the building block 15 for mating with upper notches of neighboring inserts.

Figure 17C:
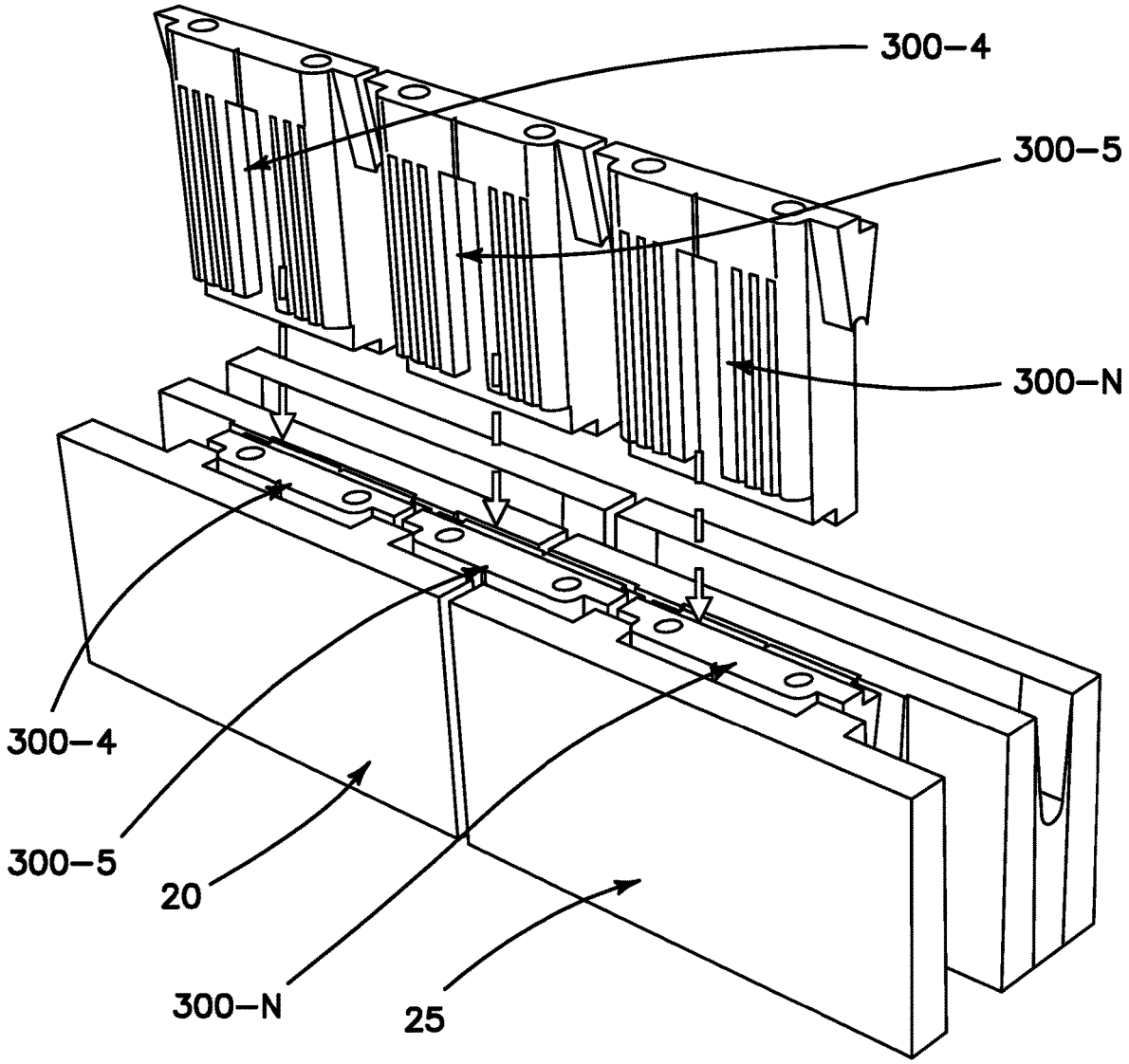
FIG. 17C illustrates multiple third embodiment first inserts positioned within a pair of building blocks according to the embodiments of the present invention.

FIG. 17C illustrates multiple third embodiment first inserts 300-4 through 300-N positioned within a pair of building blocks 20, 25 according to the embodiments of the present invention.

Figure 18A:
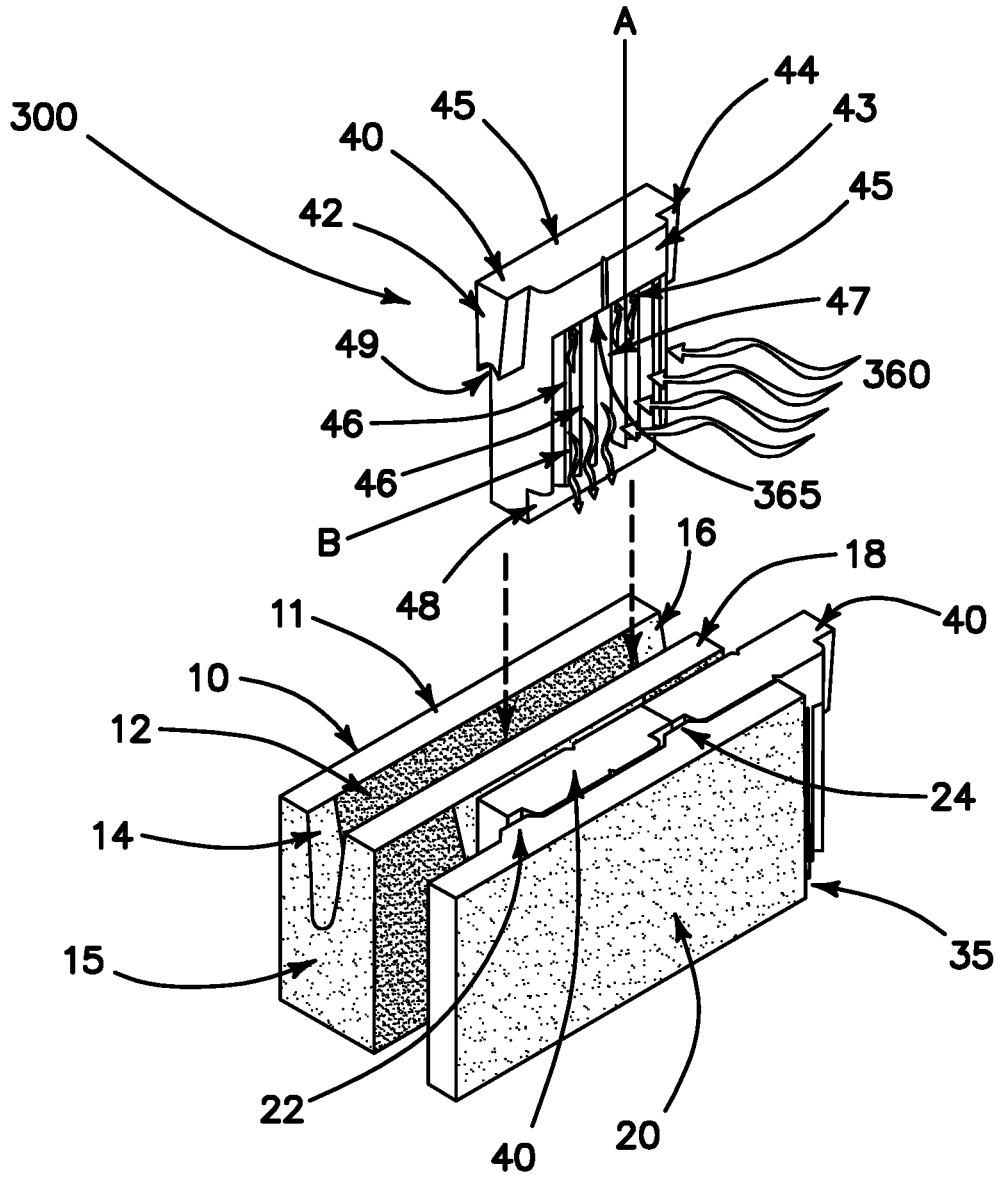
FIGS. 18A and 18B illustrate third embodiment first inserts and second embodiment second inserts interacting with sounds waves according to the embodiments of the present invention.
Figure 18B:
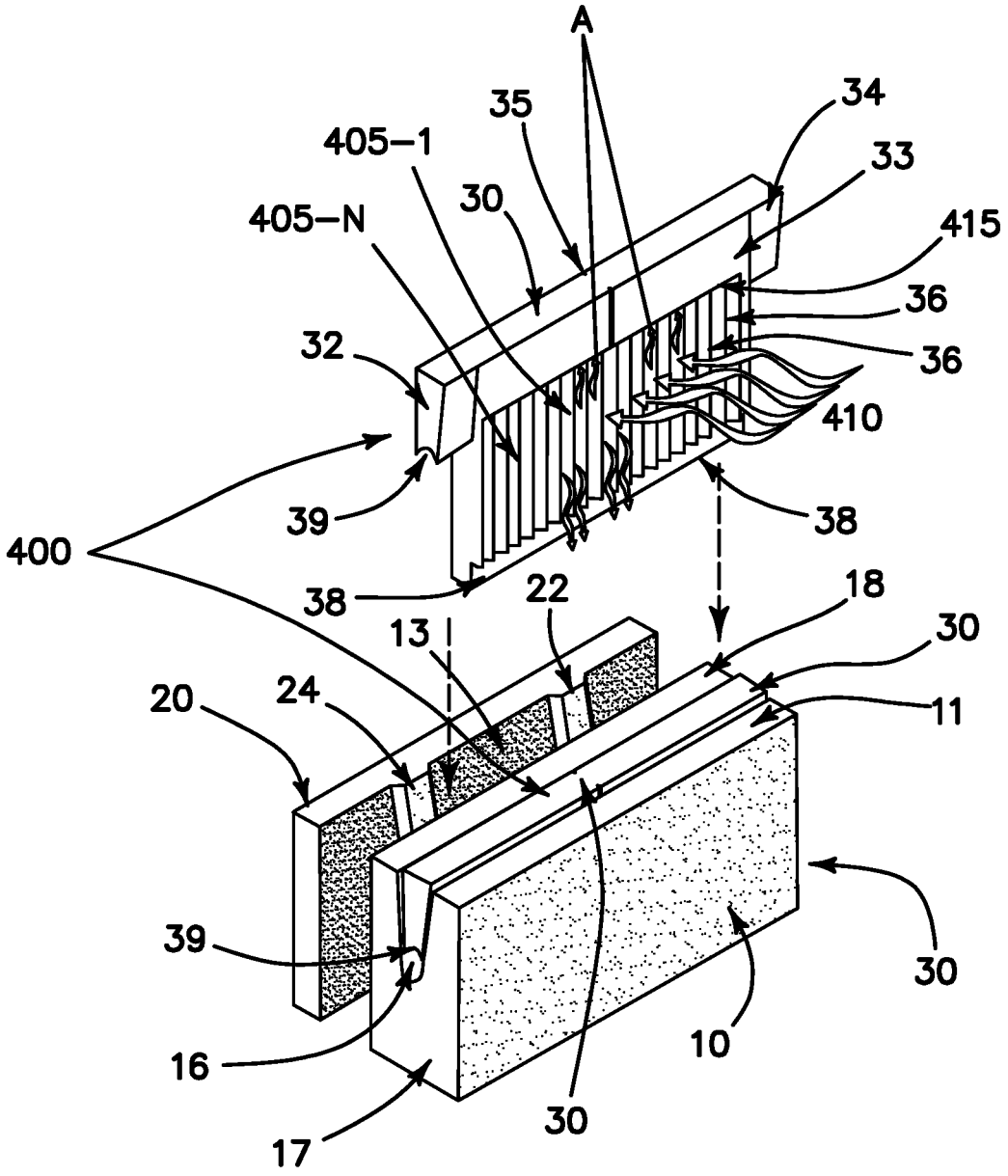

FIGS. 18A and 18B illustrate third embodiment first inserts 300 and second embodiment second insert 400 interacting with sounds waves according to the embodiments of the present invention. As the sounds waves 360, 410 contact the inserts 300, 400 the sound waves disseminate upwards (arrow A) and downwards (arrow B) along channels 305-1 through 305-N and channels 405-1 through 405-N, respectively. By re-directing the sound waves, less sound is able to penetrate the building block and inserts and exit into the protected area.

In one embodiment, the inserts have a height of 7.87" or 0.13" (⅛") short of 8" which equals the sum of the a 7.625" tall building block and the 0.375" thick butt mortar joint. This height permits the inserts to overlap as detailed above. Those skilled in the art will recognize that other building blocks may require the dimensions of the inserts to be modified.

Although the invention has been described in detail with reference to several embodiments, additional variations and modifications exist within the scope and spirit of the invention as described and defined in the following claims.

I claim:

1. An insulated masonry building block system for use in a mortar set masonry wall comprising:

first, second and third spaced, parallel, rectangular face shells, with said second face shell located intermediate said first and third face shells, wherein said first, second and third rectangular face shells each have a bottom edge located in a first horizontal plane and said first, second and third rectangular face shells each have a top edge located in a second horizontal plane;

first and second end cross webs connecting the ends of said first and second face shells in first and second respective planes, each of said first and second end cross webs having a notch therein extending a predetermined distance from the top edge thereof toward the bottom edge thereof;

first and second spaced intermediate cross webs located on spaced planes between the first and second planes of said first and second end cross webs and connecting said second and third face shells, said intermediate cross webs each having a notch therein extending from the top edge thereof a predetermined distance toward the bottom edge thereof;

a first insulating insert dimensioned to substantially fill the space between said first and second face shells and said first and second end cross webs, said first insulating insert having top and bottom edges, with end protrusions extending outwardly at the top edge thereof to fit into the notches in said first and second end cross webs, said end protrusions having cutouts in bottoms thereof to accommodate mortar crumbs, said first insulating insert having a longitudinal notch along the entire bottom edge and a longitudinal notch along the entire top edge wherein said longitudinal notch along the entire bottom edge is dimensioned to fit into a top longitudinal notch of a neighboring one of said first insulating inserts creating an overlap that serves to (i) insulate against temperature transfer and (ii) provide a sound barrier;

a second insulating insert dimensioned to substantially fill the space between said second and third face shells and said first and second spaced intermediate cross webs, said second insulating insert having top and bottom edges, with end protrusions extending outwardly at the top edge thereof to fit into the notches in said first and second spaced intermediate cross webs, said end protrusions having cutouts in bottoms thereof to accommodate mortar crumbs, said second insulating insert having a longitudinal notch along the entire bottom edge and a longitudinal notch along the entire top edge thereof wherein said longitudinal notch along said bottom edge is dimensioned to fit into a top longitudinal notch of a neighboring one of said second insulating inserts creating an overlap that serves to (i) insulate against temperature transfer and (ii) provide a sound barrier; and wherein the longitudinal notch along the entire top edge of said first insulating insert and the longitudinal notch along the entire top edge of said second insulating insert are positioned on adjacent sides of said first insulating insert and said second insulating insert when said first insulating insert and said second insulating insert are installed in the insulated masonry building block system.

2. The insulated masonry building block system according to claim 1 wherein said first and second spaced intermediate cross webs are spaced apart a distance which is, substantially one-half the overall length of said first, second and third face shells, and said first and, second spaced intermediate cross webs are located to cause the space between them to be substantially centered between the ends of said second and third face shells.

3. The insulated masonry building block system according to claim 2 wherein said first and second spaced intermediate cross webs are spaced apart a distance which is substantially half the length of said first, second and third face shells, with said first intermediate cross web located inwardly from a first end of said second and third face shells a distance approximately one-fourth of the overall length of said first and second face shells.

4. The insulated masonry building block system according to claim 3 wherein said first, second and third rectangular face shells, said first and second end cross webs, and said first and second intermediate cross webs are formed from concrete.

5. The insulated masonry building block system according to claim 4 wherein the notches in said first and second end cross webs and in said first and second spaced intermediate cross webs have a generally U-shaped configuration.

6. The insulated masonry building block system according to claim 1 wherein said first, second and third rectangular face shells, said first and second end cross webs, and said first and second spaced intermediate cross webs each have a substantially uniform thickness from the top edge thereof to the bottom edge thereof.

7. The insulated masonry building block system according to claim 1 wherein said first, second and third rectangular face shells each have a substantially constant wall thickness from the top to the bottom thereof.

8. The insulated masonry building block system according to claim 1 wherein said first and second end webs and said first and second intermediate cross webs each have a substantially uniform thickness from the top to the bottom thereof.

9. The insulated masonry building block system according to claim 1 wherein the notches in said first and second vertical end webs and in said first and second spaced intermediate cross webs have a generally U-shaped configuration.

10. The insulated masonry building block system according to claim 1 wherein said first and second spaced intermediate cross webs are spaced apart a distance which is substantially one-half the overall length of said first, second and third face shells, and said first and second spaced intermediate cross webs are located to cause the space between them to be substantially centered between the ends of said second and third face shells.

* * * * *